US005344123A

United States Patent [19]

Hanano et al.

[11] Patent Number: 5,344,123

[45] Date of Patent: Sep. 6, 1994

[54] MELTING AND FILLING DEVICE

[75] Inventors: Takashi Hanano, Kobe; Shigeo Furuta, Takarazuka, both of Japan

[73] Assignee: Hanano Corporation, Hyogo, Japan

[21] Appl. No.: 173,480

[22] Filed: Dec. 27, 1993

Related U.S. Application Data

[63] Continuation of Ser. No. 979,272, Nov. 20, 1992, abandoned.

[30] Foreign Application Priority Data

Jan. 31, 1992 [JP] Japan ..... 4-016091

[51] Int. Cl.[5] ..... B22D 39/00

[52] U.S. Cl. ..... 266/207; 266/236

[58] Field of Search ..... 266/200, 236, 207, 275; 164/513

[56] References Cited

U.S. PATENT DOCUMENTS

| | | | |
|---|---|---|---|
| 1,822,939 | 9/1931 | Stout | 266/200 X |
| 2,287,671 | 6/1942 | Dunsheath et al. | 266/200 X |
| 2,858,586 | 11/1958 | Brennan | 266/207 X |
| 2,863,187 | 12/1958 | Van Dusen et al. | 164/513 |
| 3,116,998 | 1/1964 | Pagonis | 266/207 X |
| 3,247,555 | 4/1966 | Keating | 266/200 X |
| 4,347,889 | 9/1982 | Komatsu et al. | 164/513 X |

FOREIGN PATENT DOCUMENTS

| | | | |
|---|---|---|---|
| 55-36033 | 3/1980 | Japan | 164/513 |
| 3-106547 | 5/1991 | Japan | 164/312 |
| 3-85154 | 8/1991 | Japan . | |
| 594177 | 2/1978 | U.S.S.R. | 266/207 |
| 1294927 | 11/1972 | United Kingdom | 266/200 |

*Primary Examiner*—J. Reed Batten, Jr.

*Attorney, Agent, or Firm*—Armstrong, Westerman, Hattori, McLeland & Naughton

[57] ABSTRACT

The device has a device body including an inside space having an airtightness able to provide a nonactive gas atmosphere, the inside space having a charging port, a filling port and a melting chamber surrounded by an induction heating coil; a first piston transporting a non-ferrous alloy lump to the melting chamber; and a second piston permitting the melted non-ferrous alloy to flow out of the filling port.

2 Claims, 3 Drawing Sheets

MELTING AND FILLING DEVICE

This application is a continuation of application Ser. No. 07/979,272 filed Nov. 20, 1992, abandoned.

BACKGROUND ART

1. Industrial Useful Field

This invention relates to a melting and filling device able to melt a non-ferrous alloy lump and fill the melted alloy into a mold when casting a non-ferrous alloy, by a simple process without consuming an excess amount of the non-ferrous alloy lump and without accompanying any decomposition.

2. Prior Art

A work for melting a non-ferrous alloy lump and filling it into a mold has so far been carried out through the following processes (1) to (3).

(1) A process in which a non-ferrous alloy ingot (including a return material) is melted by a melting furnace.

(2) A process in which a molten metal obtained by the melting process is once pooled in a separate furnace or ladle.

(3) A process in which a required amount of molten metal is taken out of the pooled molten metal and filled into a mold.

PROBLEM TO BE SOLVED BY THE INVENTION

The above work has included such problems as follows:

(a) Losses of time and thermal energy during a period from the melting to the filling have been considerable. The loss of thermal energy has amounted to several percent to 10 percent.

(b) It has been frequently occurred to melt the alloy more than necessary, so that the non-ferrous alloy has been consumed uselessly.

(c) There has been a possibility of decomposition in the cast non-ferrous alloy. Namely, there have been possibilities of a formation of intermetallic compound due to oxidation and an absorption of gas in atmosphere because of a contact of the lump and molten metal of non-ferrous alloy with atmosphere. Further, there has been a possibility of formation of segregation in the molten metal by sedimentation during the pooling process.

SUMMARY OF THE INVENTION

An object of this invention is to provide a melting and filling device which can solve the above problems (a) through (c).

The present invention provides a melting and filling device for melting a non-ferrous alloy lump and filling the melted lump into a mold; characterized in that the device has a device body including an inside space having an airtightness able to provide a nonactive gas atmosphere, the inside space having a charging port, a filling port and a melting chamber surrounded by an induction heating coil; a transport means transporting the non-ferrous alloy lump to the melting chamber, which is charged from the preheating chamber to the inside space; and a delivery means pushing the molten metal of non-ferrous alloy out of the filling port, which is formed in the melting chamber.

The non-ferrous alloy lump charged in the inside space of the device body is melted in the melting chamber of the inside space, and filled from the filling port into the mold. The molten non-ferrous alloy is filled directly from the filling port into the mold without being pooled in a separate vessel. In addition, the non-ferrous alloy lump is melted in an extremely short time when an electric power having a proper frequency is applied to the induction heating coil. Further, the entire charged non-ferrous alloy lump is melted and filled from the filling port into the mold. Moreover, the non-ferrous alloy has no chance to be in contact with atmosphere during a period from the charging to the filling when the inside space is put under an inert gas atmosphere.

DETAILED DESCRIPTION OF THE INVENTION

An embodiment of this invention will be described with reference to the attached drawings.

Figure 1:
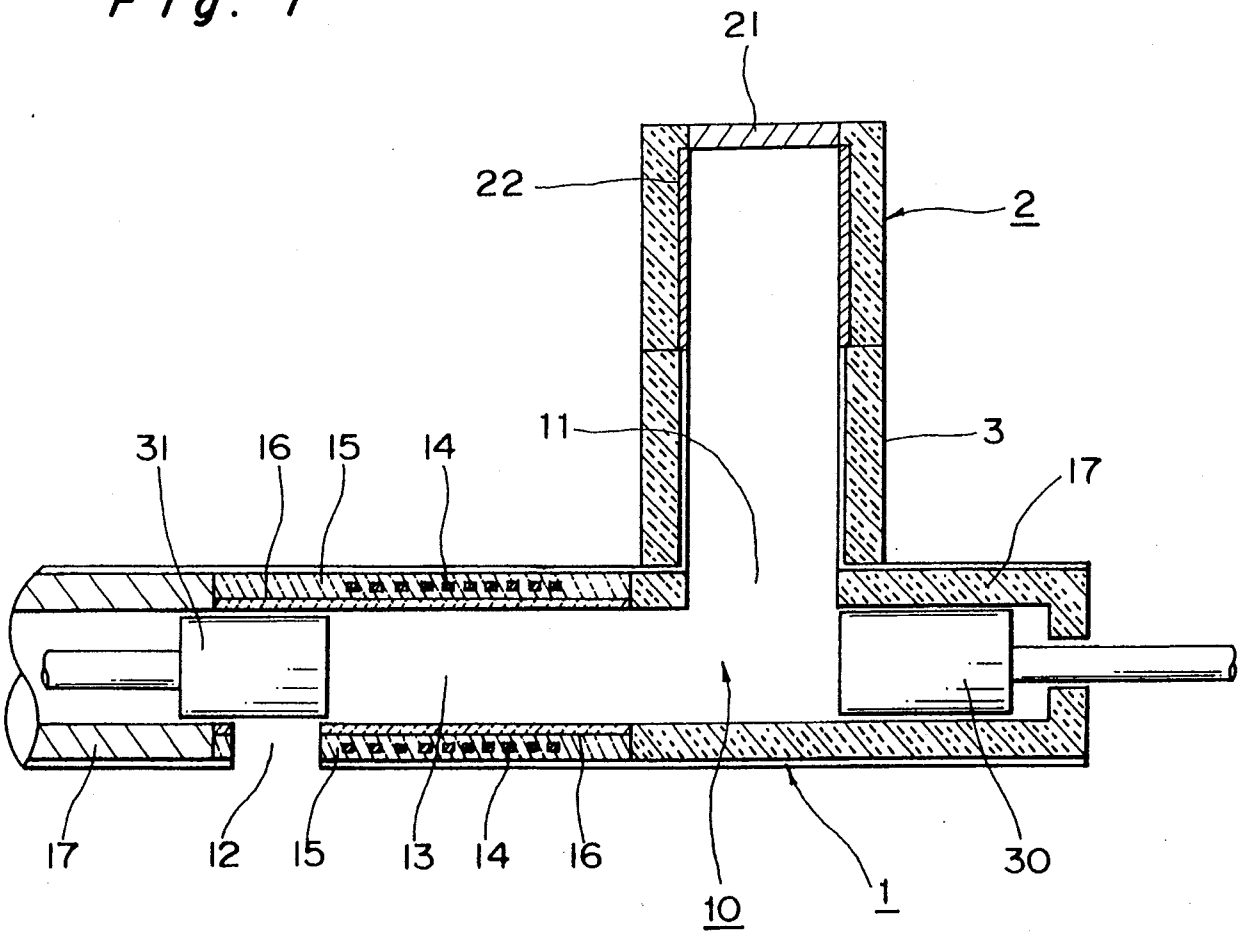
FIG. 1 is a sectional view showing a melting and filling device of this invention.

FIG. 1 is the sectional view showing the melting and filling device of this invention. 1 denotes a cylindrical device body, and 2 denotes a cylindrical pre-heating chamber. The device body 1 is so constructed as to compose an inside space 10 provided with an airtightness by blocking a charging port 11 and filling port 12. A part of the inside space 10 forms a melting chamber 13. The melting chamber 13 is so constructed as to be surrounded by an induction heating coil 14. The induction heating coil 14 is buried in an external cylinder 15 comprising a refractory material, and an internal cylinder 16 comprising a ceramic material having a good electrical insulating property is installed in an inside of the external cylinder 15. Other peripheral walls 17 excluding the melting chamber 13 of the device body 1 are composed of heat insulating material.

A first piston 30 and a second piston 31 fit in the inside space 10 airtightly in a freely movable manner. The first piston 30 is movable in a leftward direction (of FIG. 1) up to a position just this side of the filling port 12, and the second piston 31 is movable in a right direction up to a position blocking the filling port 12. The first piston 30 is so designed as to airtightly block the charging port 11 just under the charging port 11, and the second piston 31 is so designed as to airtightly block the filling port 12 just above the filling port 12.

The pre-heating chamber 2 is airtightly connected to the charging port 11 through a cylindrical passage 3. 21 denotes a cover of the pre-heating chamber 2, and 22 denotes an electric heating portion installed on an inner peripheral surface of the pre-heating chamber 2. An resistance electric heating type or an induction heating type may be used for the electric heating portion 22. The pre-heating chamber 2 and the passage 3 are provided with the airtightness under a state where the cover 21 is closed. The peripheral walls of the pre-heating chamber 2 and the passage 3 are naturally made of heat insulating material.

A work using the melting and filling device as constructed above is carried out in the following way.

Figure 2:
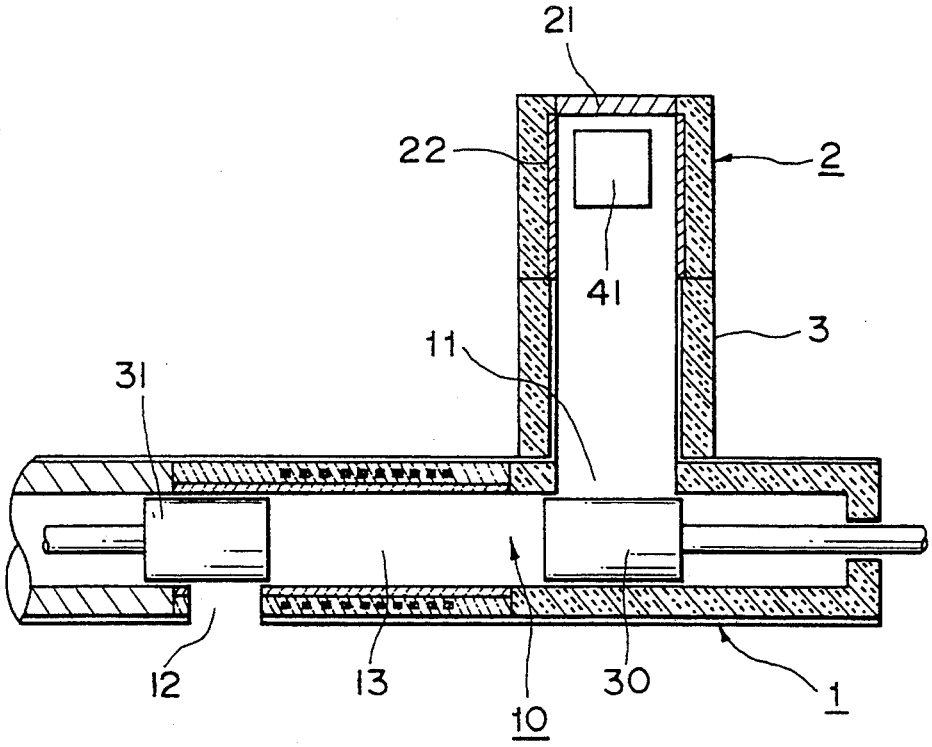
FIG. 2 through FIG. 5 are sectional views showing one process of work using the melting and filling device respectively.
Figure 3:
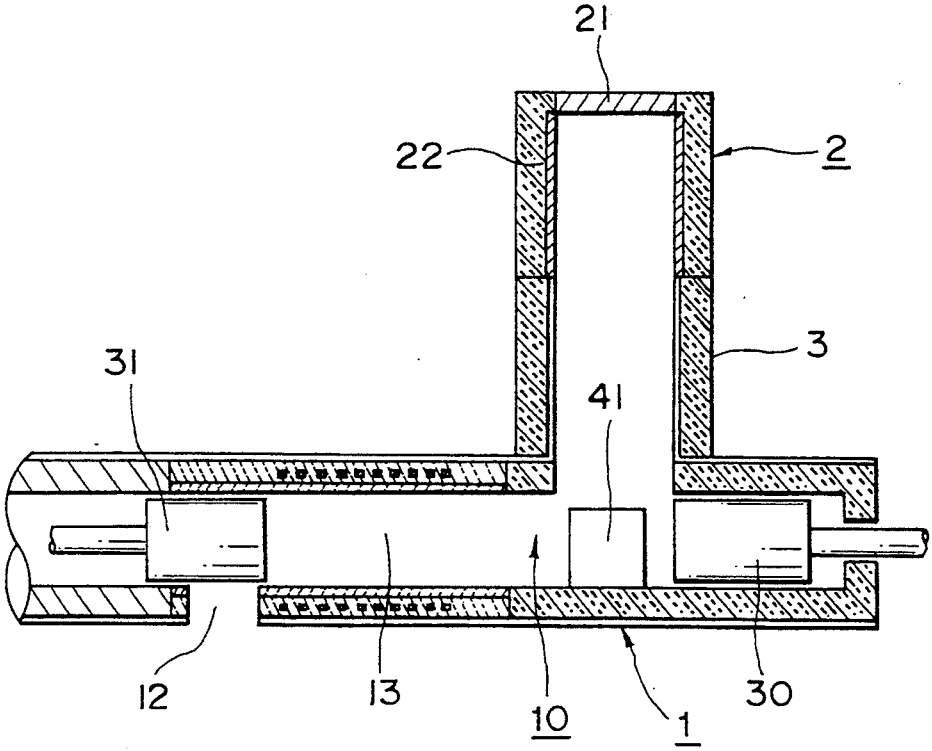
Figure 4:
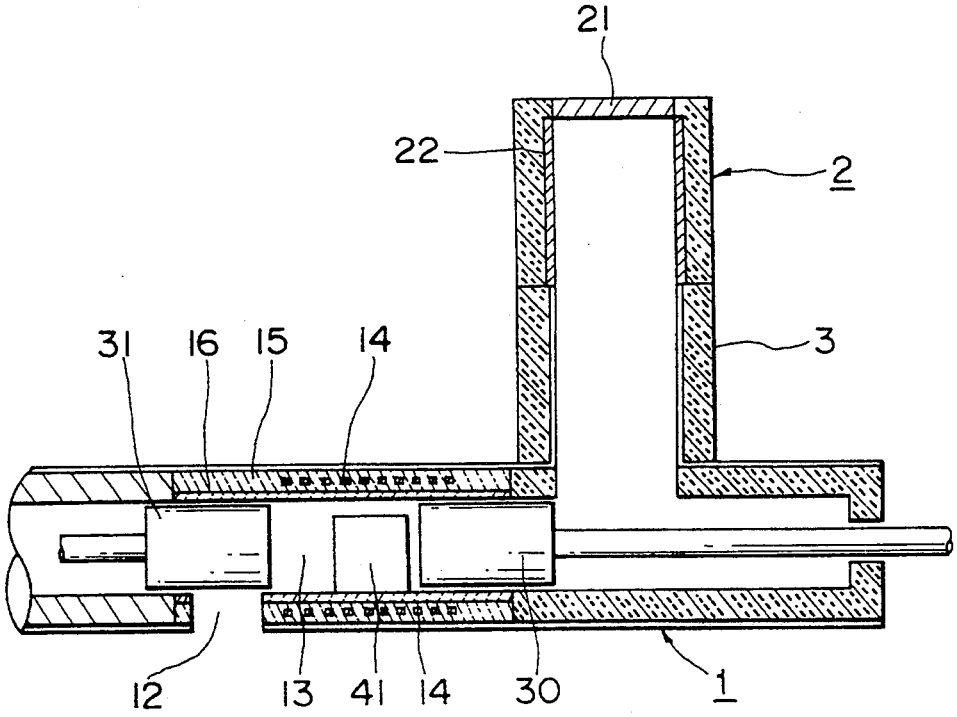
Figure 5:
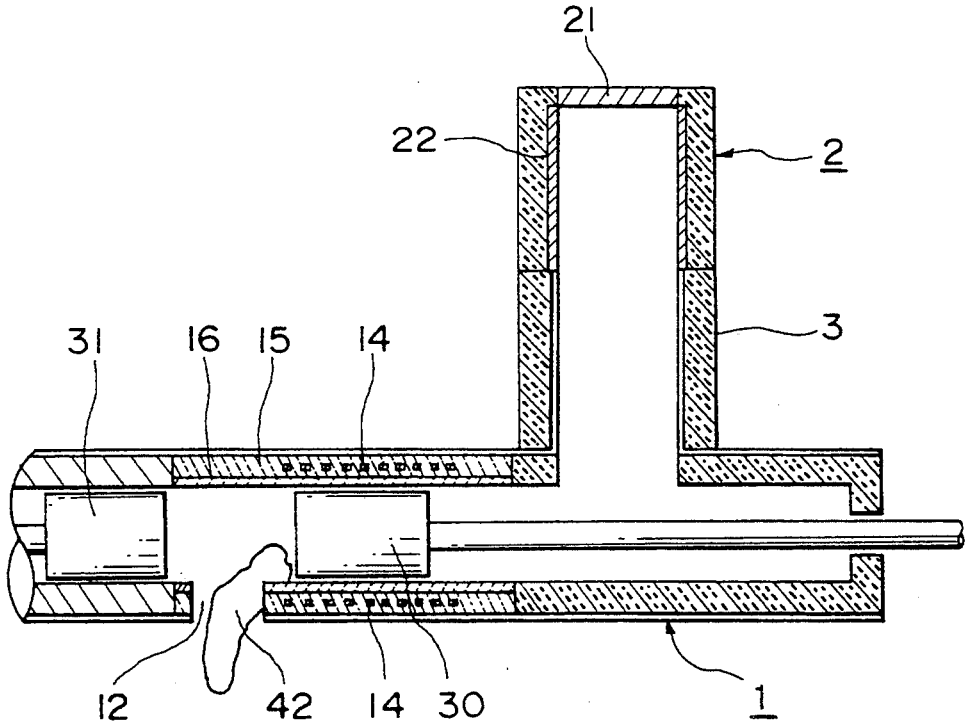

In the first place, inert gas such as argon etc. for example is filled in the pre-heating chamber 2, the passage 3 and inside space 10 under a state where the filling port 12 is blocked by the second piston 31, and the cover 21 is closed, as illustrated in FIG. 1. In the next place, as illustrated in FIG. 2, the charging port 11 is blocked by the first piston 30, the cover 21 is opened, and a lump 41 of non-ferrous alloy such as an aluminum alloy weighed to a required amount is charged in the pre-heating chamber 2. The lump 41 may consist of plural pieces. In the third place, the electric heating portion 22 of the pre-heating chamber 2 is energized so as to heat the lump 41 up to a specified temperature. After the lump 41 has reached the specified temperature, the first piston 30 is moved in the left direction to open the charging port 11, and the lump 41 is charged in the inside space 10, as illustrated in FIG. 3. In the fourth place, the first piston 30 is moved in the right direction to move the lump 41 into the melting chamber 13 as illustrated in FIG. 4, and the first piston 30 is moved in the right direction so as to be located at an outside of the melting chamber 13. Under this state, a power having an appropriate frequency is applied to the induction heating coil 14 so as to melt the lump 41. The frequency to be applied is set voluntarily according to a kind and amount of the lump 41 to be melted. After completion of the melting of the lump 41, the induction heating coil 14 is unenergized and the second piston 31 is moved in the left direction to open the filling port 12 as illustrated in FIG. 5, so that a molten metal 42 obtained by the melting procedure is pushed out of the filling port 12 by moving the first piston 30 in the left direction. A mold is installed close to the filling port 12 so that the pushed out molten metal 42 is poured into the mold without fail. After completion of filling of the molten metal into the mold, the first piston 30 and the second piston 31 are returned to the respective states of FIG. 1. It is designed to supplement a leakage of the inert gas from outside even during the above work. Further, the first piston 30 serves not only as a transport means for transporting the lump 41 to the melting chamber 13 but also as a delivery means for pushing the molten metal 42 out of the filling port 12.

As described above, the melting and filling device thus constructed has the following advantages. (1) The molten metal 42 obtained in the melting chamber 13 is filled directly from the filling port 12 into the mold without being pooled in a separate vessel. Accordingly, the loss of thermal energy in the work is small as compared with a conventional case. In addition, the power having an appropriate frequency is applied to the induction heating coil 14 so that the lump 41 is melted in an extremely short time. Consequently, the work can be done within a short time so that the loss of time is small as compared with a conventional case. (2) The entire charged lump 41 is melted and filled into the mold from the filling port 12. Therefore, it is enough to charge only a required amount of the lump 41, so that the non-ferrous alloy is not consumed uselessly. (3) The pre-heating chamber 2, the passage 3 and the inside space 10 are put under the inert gas atmosphere and the leakage of the inert gas is supplemented, so that the lump 41 and the molten metal 42 have no chance to be in contact with atmosphere during the period from the charging to the filling. Therefore, the lump 41 and the molten metal 42 are not decomposed by the contact with atmosphere. In short, there is no chance for the intermetallic compound to be produced in the lump 41 and the molten metal 42 due to oxidation, and there in no chance for gas existing in atmosphere to be absorbed by them. Further, since the melted metal 42 is filled immediately after being molten, there is no possibility of the formation of segregation in the molten metal 42 while it settles.

An embodiment will be described hereinafter.

An aluminum alloy as listed in Table 1 was used for the non-ferrous alloy, and 15 pieces of aluminum alloy lump were prepared. One lump had a cylindrical shape having a diameter of about 70 mm, a length of about 200 mm and a weight of 2 kg.

TABLE 1

| Component | Si | Mg | Fe | Mn | Al |
|---|---|---|---|---|---|
| Weight % | 10.83 | 0.08 | 0.56 | 0.08 | 88.21 |

A device including the following principal parts was used. The internal cylinder 16 was made of sialon and had an inside diameter of 90 mm, an outside diameter of 110 mm and a length of 300 mm. The induction heating coil 14 had an inside diameter of 100 mm and a coil length of 220 mm. The pre-heating chamber 2 included a volume able to incorporate 5 pieces of lump, the electric heating portion 22 was of a resistance electric heating type, and a heating wire having a brand name of "PYROMAX DS" was used. The airtightness was secured by a closed-system for the pre-heating chamber 2, the passage 3 and the inside space 10.

The above-mentioned lumps were divided into each group of five pieces, and each group was melted and filled in atmosphere, surrounding gas of nitrogen, and surrounding gas of argon, respectively.

All the pre-heating procedures were done at 400° C.±5° C. The frequency applied to the induction heating coil 14 was 3,000 Hz. However, since the molten metal was stirred, the frequency was 1,000 Hz during raising the melting temperature from 640° C. up to 690° C. The melting time was 16 sec.±0.5 sec. The molten metal was filled into a metal mold (mold) pre-heated to 300° C.

Tensile test pieces were made from all of each five castings obtained by melting and filling the alloy under the above three kinds of atmospheres, and were subjected to tensile strength tests. Results are listed in Table 2.

TABLE 2

| Surrounding gas | Atmosphere | Nitrogen | Argon |
|---|---|---|---|
| Tensile strength ($kg/mm^2$) | 19.5 ± 1.3 | 20.1 ± 1.4 | 23.4 ± 1.1 |

In Casting Standard (JIS H5202-1971) for silumin group alloy of such type, the standard value is specified as 18 $kg/mm^2$ or larger. However, as understood from Table 2, the test pieces have tensile strengths which are larger than the standard value even under the atmosphere similar to conventional one. This may be attributable to a fact that the decomposition due to segregation is not produced in the aluminum alloy used because the alloy is melted and filled rapidly. Moreover, the strengths become further large under surroundings of inert gases using nitrogen and argon. This may be attributable to a fact that not only the decomposition due to segregation but also the decomposition caused by contact with atmosphere are not produced in the aluminum alloy used.

As described above, the melting and filling device of this invention is effective in the following points.

(1) The molten metal 42 obtained in the melting chamber 13 can be filled directly from the filling port 12 into the mold without being pooled in a separate vessel.

Accordingly, the loss of thermal energy in the work can be made small as compared with the conventional case. In addition, the power having an appropriate frequency is applied to the induction heating coil 14 so that the lump 41 can be molten in an extremely short time. Consequently, the work can be done within a short time so that the loss of time can be made small as compared with the conventional case.

(2) All of the charged non-ferrous alloy lumps 41 are entirely melted and can be filled into the mold from the filling port 12. Therefore, the non-ferrous alloy is prevented from being consumed uselessly by only charging the lump 41 of an amount necessary for casting.

(3) The pre-heating chamber 2, the passage 3 and the inside space 10 are put under the atmosphere of inert gas so that the non-ferrous alloy lump 41 and the molten metal 42 of non-ferrous alloy can be prevented from contacting with atmosphere during the period from the charging to the filling. Therefore, the non-ferrous alloy lump 41 and the molten metal 42 of non ferrous alloy can be prevented from being decomposed by the contact with atmosphere. Further, since the molten metal 42 can be filled immediately after being melted, the molten metal 42 can be prevented from being decomposed by the sedimentation.

What is claimed is:

1. A melting and filling device for melting a non-ferrous alloy lump and transferring the melted alloy to a mold, comprising:

a device body including an inside space having an airtightness able to provide an nonactive gas atmosphere, the inside space having a charging port, a filling port and a melting chamber surrounded by an induction heating coil;

a first piston for transporting the non-ferrous alloy lump to the melting chamber;

and a second piston, axially aligned with the first piston, for allowing the molten metal of non-ferrous alloy, formed in the melting chamber, to flow out of the filling port.

2. A melting and filling device as set forth in claim 1, in which a pre-heating chamber for pre-heating the non-ferrous alloy lump to be charged into the inside space is connected to the charging port in such a manner that the pre-heating chamber together with the inside space are provided with an airtightness.

* * * * *